US011521568B2

(12) United States Patent
Chen

(10) Patent No.: US 11,521,568 B2
(45) Date of Patent: Dec. 6, 2022

(54) DISPLAY PANEL, DISPLAY DEVICE AND DRIVING METHOD FOR DISPLAY PANEL

(71) Applicant: Xianyang Caihong Optoelectronics Technology Co., Ltd, Xianyang (CN)

(72) Inventor: Yu-Yeh Chen, Xianyang (CN)

(73) Assignee: XIANYANG CAIHONG OPTOELECTRONICS TECHNOLOGY CO., LTD., Xianyang (CN)

( * ) Notice: Subject to any disclaimer, the term of this patent is extended or adjusted under 35 U.S.C. 154(b) by 0 days.

(21) Appl. No.: 17/502,194

(22) Filed: Oct. 15, 2021

(65) Prior Publication Data

US 2022/0036839 A1 Feb. 3, 2022

Related U.S. Application Data

(63) Continuation of application No. PCT/CN2019/118417, filed on Nov. 14, 2019.

(30) Foreign Application Priority Data

Apr. 16, 2019 (CN) ..... 201910302480.X

(51) Int. Cl.
*G09G 3/36* (2006.01)

(52) U.S. Cl.
CPC ... *G09G 3/3607* (2013.01); *G09G 2300/0452* (2013.01); *G09G 2320/0242* (2013.01); *G09G 2320/0673* (2013.01)

(58) Field of Classification Search
CPC .. G09G 3/3607; G09G 3/3614; G09G 3/2007; G09G 3/2074; G09G 2300/0452; G09G 2300/0447; G09G 2320/0242; G09G 2320/0673; G09G 2320/0271
See application file for complete search history.

(56) References Cited

U.S. PATENT DOCUMENTS

2006/0290626 A1* 12/2006 Arimoto ..... G09G 3/20 345/87
2010/0033473 A1* 2/2010 Hsieh ..... G09G 3/003 345/94
2010/0103339 A1* 4/2010 Shimoshikiryoh .. G09G 3/3648 349/39

(Continued)

FOREIGN PATENT DOCUMENTS

CN 109346020 A 2/2019

*Primary Examiner* — David Tung
(74) *Attorney, Agent, or Firm* — WPAT, PC

(57) ABSTRACT

A display panel, a display device and a driving method for a display panel are provided. The display panel includes multiple pixel units and a display control unit. Each of the pixel units includes a first color pixel, a second color pixel and a third color pixel. The first color pixel, the second color pixel and the third color pixel each include a first sub-pixel, a second sub-pixel and a third sub-pixel. The display control unit includes a first controller, a second controller and a third controller. By means of combining three kinds of gamma curves e.g., first through third gamma curves and taking a 4-domain pixel structure as a basis, a display effect based on a 12-domain pixel structure can be realized, so that the color shift problem in side view of the display panel can be significantly improved.

13 Claims, 4 Drawing Sheets

(56) References Cited

U.S. PATENT DOCUMENTS

| | | | | |
|---|---|---|---|---|
| 2014/0104523 | A1* | 4/2014 | Jung | G02F 1/1343 349/41 |
| 2016/0217593 | A1* | 7/2016 | Huang | G09G 3/207 |
| 2018/0114478 | A1* | 4/2018 | Tien | G09G 3/2074 |

* cited by examiner

| R | G | B | R | G | B | R | G | B | R | G | B | R | G | B | R | G | B |
|---|---|---|---|---|---|---|---|---|---|---|---|---|---|---|---|---|---|
| H | L | H | L | H | L | L | L | L | H | L | H | L | H | L | L | L | L |
| L | L | L | H | L | H | L | H | L | L | L | L | H | L | H | L | H | L |
| L | H | L | L | L | L | H | L | H | L | H | L | L | L | L | H | L | H |
| H | L | H | L | H | L | L | L | L | H | L | H | L | H | L | L | L | L |
| L | L | L | H | L | H | L | H | L | L | L | L | H | L | H | L | H | L |
| L | H | L | L | L | L | H | L | H | L | H | L | L | L | L | H | L | H |

FIG. 8

| R | G | B | R | G | B | R | G | B | R | G | B | R | G | B | R | G | B |
|---|---|---|---|---|---|---|---|---|---|---|---|---|---|---|---|---|---|
| H | L | H | H | H | H | L | H | L | H | L | H | H | H | H | L | H | L |
| L | H | L | H | L | H | H | H | H | L | H | L | H | L | H | H | H | H |
| H | H | H | L | H | L | H | L | H | H | H | H | L | H | L | H | L | H |
| H | L | H | H | H | H | L | H | L | H | L | H | H | H | H | L | H | L |
| L | H | L | H | L | H | H | H | H | L | H | L | H | L | H | H | H | H |
| H | H | H | L | H | L | H | L | H | H | H | H | L | H | L | H | L | H |

FIG. 9

| R | G | B | R | G | B | R | G | B | R | G | B | R | G | B | R | G | B |
|---|---|---|---|---|---|---|---|---|---|---|---|---|---|---|---|---|---|
| H | L | H | M | H | M | L | M | L | H | L | H | M | H | M | L | M | L |
| L | M | L | H | L | H | M | H | M | L | M | L | H | L | H | M | H | M |
| M | H | M | L | M | L | H | L | H | M | H | M | L | M | L | H | L | H |
| H | L | H | M | H | M | L | M | L | H | L | H | M | H | M | L | M | L |
| L | M | L | H | L | H | M | H | M | L | M | L | H | L | H | M | H | M |
| M | H | M | L | M | L | H | L | H | M | H | M | L | M | L | H | L | H |

FIG. 10

DISPLAY PANEL, DISPLAY DEVICE AND DRIVING METHOD FOR DISPLAY PANEL

TECHNICAL FIELD

The invention relates to the technical field associated with display panels, and more particularly to a display panel, a display device, and a driving method for a display panel.

DESCRIPTION OF BACKGROUND

With the progress of science and technology, display devices with superior characteristics such as light and thin size, low power consumption and no radiation have gradually replaced traditional cathode ray tube display devices and are applied to many kinds of electronic products, such as mobile phones, portable multimedia devices, notebook computers, LCD TVs, LCD screens and so on.

The display device such as a liquid crystal display device includes a backlight module and a display panel. The display panel generally is composed of a color filter (CF) substrate, a thin film transistor (TFT) array substrate, and a liquid crystal layer arranged between the two substrates, and a working principle thereof is to control rotations of liquid crystal molecules of the liquid crystal layer by applying driving voltages on two glass substrates, and refract light from the backlight module to thereby produce a picture.

At present, manufacturers of the display devices have stepped into the use of optical alignment technology to control alignment directions of liquid crystal molecules at the aspect of improving the wide viewing angle technology of vertical alignment (VA) type liquid crystal display panels, thereby improving optical performance and yield of liquid crystal display panels. The optical alignment technology will form a multi-domain alignment in each pixel of the panel, so that the liquid crystal molecules in the pixel will tilt for example in four different directions. However, although the VA type liquid crystal display panel using the optical alignment technology may have the characteristics of high contrast ratio (CR) and fast response time (RT), its side view effect compared with that of a fringe field switching type or in-plane switching type liquid crystal display panel has a considerable gap in level.

It is found by the inventors that the conventional display panel still has a certain extent of whitening in side view, so that the display effect in side view is significantly different from that in normal view, and therefore it is necessary to improve one or more problems in the above-mentioned related technical solutions.

It should be noted that the information described above are only used to strengthen understanding of the background of the invention, so information that do not constitute the prior art known to those skilled in the art may be contained.

SUMMARY

Objectives of embodiments of the invention are to provide a display panel, a display device and a driving method for a display panel, so as to overcome one or more problems resulting from limitations and defects of related art at least to a certain extent.

According to a first aspect of the invention, a display panel is provided. The display panel includes:

multiple pixel units, each of the pixel units including a first color pixel, a second color pixel and a third color pixel, and each of the first color pixel, the second color pixel and the third color pixel including a first sub-pixel, a second sub-pixel and a third sub-pixel; and a display control unit, including a first controller, a second controller and a third controller;

the first controller being configured to determine a display grayscale of the first sub-pixel of the first color pixel, a display grayscale of the first sub-pixel of the second color pixel and a display grayscale of the first sub-pixel of the third color pixel according to display image data and a first gamma curve;

the second controller being configured to determine a display grayscale of the second sub-pixel of the first color pixel, a display grayscale of the second sub-pixel of the second color pixel and a display grayscale of the second sub-pixel of the third color pixel according to display image data and a second gamma curve; and the third controller being configured to determine a display grayscale of the third sub-pixel of the first color pixel, a display grayscale of the third sub-pixel of the second color pixel and a display grayscale of the third sub-pixel of the third color pixel according to display image data and a third gamma curve; and the display grayscales the first sub-pixel, the second sub-pixel and the third sub-pixel, of each of the first color pixel, the second color pixel and the third color pixels, being different.

In an exemplary embodiment of the invention, the first gamma curve, the second gamma curve and the third gamma curve are different from one another.

In an exemplary embodiment of the invention, the first sub-pixel, the second sub-pixel and the third sub-pixel, of each of the first color pixel, the second color pixel and the third color pixels, are same in number;

and/or, each of the first sub-pixel, the second sub-pixel and the third sub-pixel, of each of the first color pixel, the second color pixel and the third color pixels, is a 4-domain pixel structure.

In an exemplary embodiment of the invention, the display panel is a 4K (e.g., a resolution is 3840×2160 or 4096×2160) display panel or a 8K (e.g., a resolution is 7680×4320) display panel.

According to a second aspect of the invention, a display panel is provided. The display panel includes:

multiple pixel units, each of the pixel units including a first color pixel, a second color pixel and a third color pixel, and each of the first color pixel, the second color pixel and the third color pixel including a first sub-pixel, a second sub-pixel and a third sub-pixel; and a display control unit, including a first controller, a second controller and a third controller;

the first controller being configured to determine a display grayscale of the first sub-pixel of the first color pixel, a display grayscale of the first sub-pixel of the second color pixel and a display grayscale of the first sub-pixel of the third color pixel according to display image data and a first gamma curve;

the second controller being configured to determine a display grayscale of the second sub-pixel of the first color pixel, a display grayscale of the second sub-pixel of the second color pixel and a display grayscale of the second sub-pixel of the third color pixel according to display image data and a second gamma curve;

the third controller being configured to determine a display grayscale of the third sub-pixel of the first color pixel, a display grayscale of the third sub-pixel of the second color pixel and a display grayscale of the third sub-pixel of the third color pixel according to display image data and a third gamma curve; and the second gamma curve including a first curve segment, a second curve segment and a third curve segment, the first curve segment being overlapped with the first gamma curve, and the third curve segment being overlapped with the third gamin curve.

In an exemplary embodiment of the invention, grayscales respectively corresponding to the first curve segment, the second curve segment and the third curve segment are progressively increased.

In an exemplary embodiment of the invention, each of the first sub-pixel, the second sub-pixel and the third sub-pixel, of each of the first color pixel, the second color pixel and the third color pixel, is a 4-domain pixel structure.

In an exemplary embodiment of the invention, the display panel is a 4K display panel or a 8K display panel.

According to a third aspect of the invention, a display device is provided. The display device includes the display panel of any one of the above embodiments.

According to a fourth aspect of the invention, a driving method for a display panel is provided. The display panel includes multiple pixel units, each of the pixel units includes a first color pixel, a second color pixel and a third color pixel; and each of the first color pixel, the second color pixel and the third color pixel includes a first sub-pixel, a second sub-pixel and a third sub-pixel.

The Driving Method Includes:

determining a display grayscale of the first sub-pixel of the first color pixel, a display grayscale of the first sub-pixel of the second color pixel and a display grayscale of the first sub-pixel of the third color pixel according to display image data and a first gamma curve;

determining a display grayscale of the second sub-pixel of the first color pixel, a display grayscale of the second sub-pixel of the second color pixel and a display grayscale of the second sub-pixel of the third color pixel according to display image data and a second gamma curve;

determining a display grayscale of the third sub-pixel of the first color pixel, a display grayscale of the third sub-pixel of the second color pixel and a display grayscale of the third sub-pixel of the third color pixel according to display image data and a third gamma curve; and driving the first sub-pixels, the second sub-pixels and the third sub-pixels to present a display image according to the display grayscales of the first sub-pixels, the second sub-pixels and the third sub-pixels as determined.

In summary, the technical solutions provided by the embodiments of the invention may achieve the following beneficial effects:

in the exemplary embodiments of the invention, through the combining/adopting three kinds of gamma curves i.e., the first gamma curve, the second gamma curve and the third gamma curve, and taking a 4-domain pixel structure as a basis, a display effect based on a 12-domain pixel structure can be realized, which can significantly improve the color shift problem in side view of the display panel.

It should be understood that the above general description and the following detailed description are only exemplary and explanatory, and do not limit the invention.

BRIEF DESCRIPTION OF THE DRAWINGS

The drawings herein are incorporated into the specification and constitute a part of the specification, illustrating embodiments in accordance with the invention, and being used together with the specification to explain the principle of the invention. Apparently, the drawings described below are merely some embodiments of the invention, and those skilled in the art can obtain other drawings based on these drawings without creative efforts.

FIG. 8 is a schematic view of an arrangement of first sub-pixels and third sub-pixels when a displayed grayscale is a low grayscale according to an exemplary embodiment of the invention.

FIG. 9 is a schematic view of an arrangement of first sub-pixels and third sub-pixels when a displayed grayscale is a high grayscale according to an exemplary embodiment of the invention.

FIG. 10 is a schematic view of an arrangement of first sub-pixels, second sub-pixels and third sub-pixels when a displayed grayscale is a medium grayscale according to an exemplary embodiment of the invention.

DETAILED DESCRIPTION OF EMBODIMENTS

Figure 1:
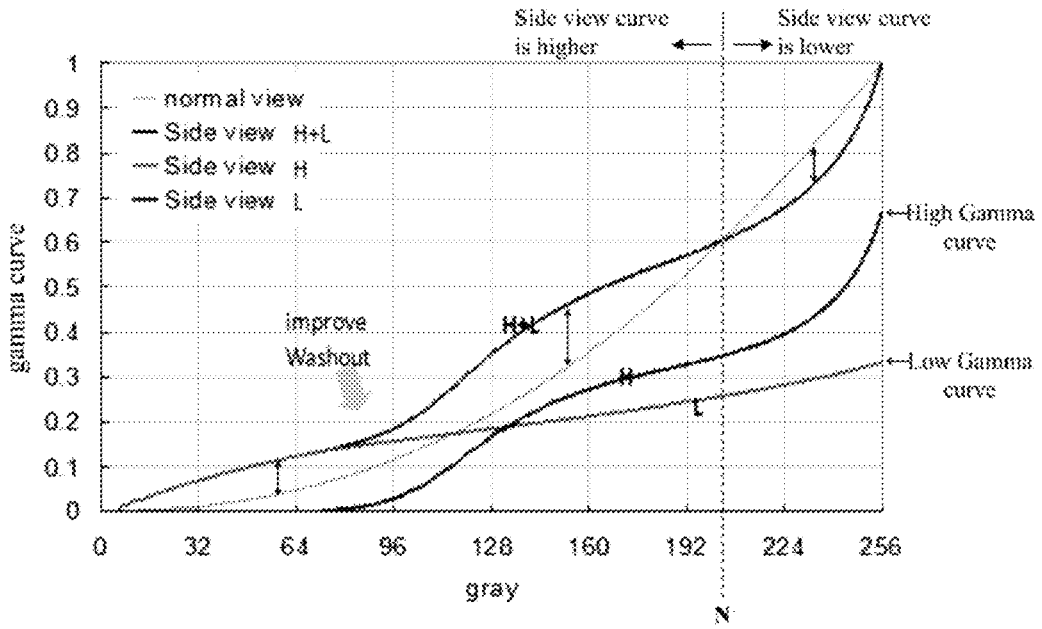
FIG. 1 is a schematic diagram of gamma curves corresponding to normal view and side views of a 8-domain pixel display unit in a related art.

Exemplary embodiments will be described below more fully with reference to the accompanying drawings. However, the exemplary embodiments can be implemented in various forms, and the invention should not be construed as being limited to the exemplary embodiments set forth herein. On the contrary, the provision of these embodiments makes the invention more comprehensive and complete, and fully conveys the concept of the exemplary embodiments to those skilled in the art. The described features, structures or characteristics can be combined in one or more embodiments in any suitable way.

In addition, the drawings are only schematic illustrations of the invention, and are not necessarily drawn to scale. The same reference numerals in the drawings denote the same or similar parts, and thus their repeated description will be omitted. Some block diagrams shown in the drawings are functional entities and do not necessarily correspond to physically or logically independent entities. These functional entities can be implemented in the form of software, or implemented in one or more hardware modules or integrated circuits, or implemented in different networks and/or processor devices and/or micro-controller devices.

Referring to FIG. 1, which is a schematic diagram of gamma curves corresponding to normal view and side views of a 8-domain pixel display unit in a related art. In particular, four sub-pixels are used, each of the four sub-pixels adopts a four-domain alignment, two of the sub-pixels serve as bright areas, and the other two of the sub-pixels serve as dark areas. In FIG. 1, the normal curve represents a gamma curve in normal view, the H curve represents a gamma curve for the sub-pixel with a relatively bright grayscale, the L curve represents a gamma curve for the sub-pixel with a relatively dark grayscale, the (H+L) curve represents a sum of the gamma curves for the sub-pixel with the relatively bright grayscale and the sub-pixel with the relatively dark grayscale. The sub-pixel with the relatively bright grayscale and the sub-pixel with the relatively dark grayscale are combined into a new pixel display unit with a 8-domain alignment, which can improve to a certain extent the whitening of the display panel in side view. Although FIG. 1 can improve the whitening problem of the VA type display panel through the low color shift (LCS) technology, as seen from FIG. 1, it can be found that when the grayscale is less than N, the gamma curve (H+L) in side view is larger in value than that of the gamma curve in normal view, and whereas when the grayscale is greater than N, the gamma curve (H+L) in side view is smaller in value than that of the gamma curve in normal view, and therefore the new 8-domain pixel display unit composed of the sub-pixel with the relatively bright grayscale and the sub-pixel with the relatively dark grayscale still can not achieve a display effect in side view approximating that in normal view.

Figure 2:
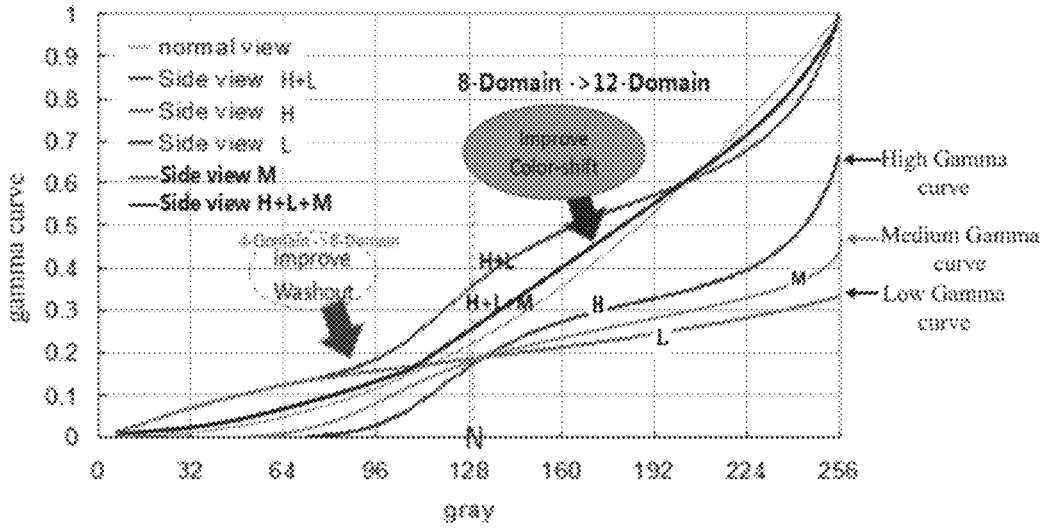
FIG. 2 is a schematic diagram of gamma curves corresponding to normal view and side views of a 12-domain pixel display unit according to an exemplary embodiment of the invention.
Figure 3:
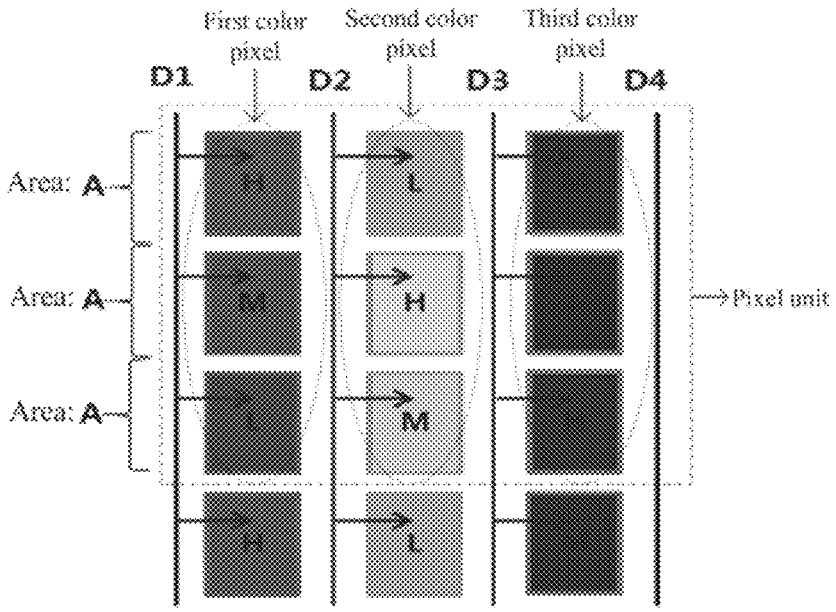
FIG. 3 shows a display manner based on a 12-domain pixel structure according to an exemplary embodiment of the invention.
Figure 4:
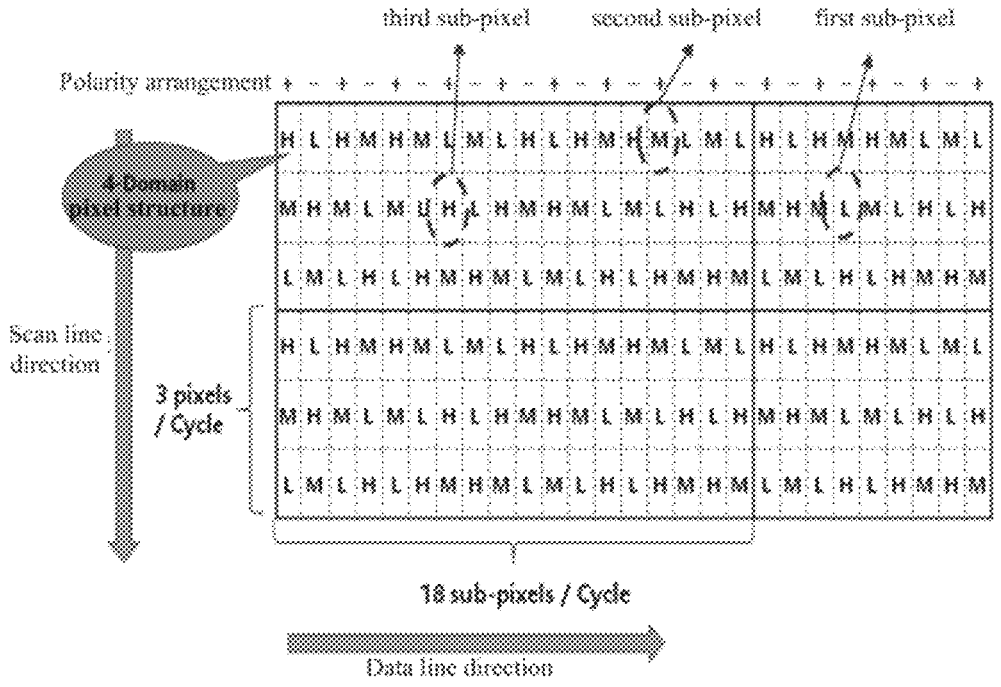
FIG. 4 is a schematic view of an arrangement of first sub-pixels, second sub-pixels and third sub-pixels according to an exemplary embodiment of the invention.

In an exemplary embodiment of the invention, a display panel is first provided. The display panel may be applied to a terminal equipment, such as a mobile phone, a personal digital assistant, a notebook computer, a tablet computer, a smart watch and other mobile terminal. Referring to FIG. 2 through FIG. 4, the display panel includes multiple (i.e., more than one) pixel units and a display control unit.

Each of the pixel units includes a first color pixel, a second color pixel and a third color pixel. Each of the first color pixel, the second color pixel and the third color pixel includes a first sub-pixel, a second sub-pixel and a third sub-pixel.

The display control unit includes a first controller; a second controller and a third controller.

The first controller is configured (i.e., structured and arranged) to determine display grayscales of the first sub-pixels of the first color pixel, the second color pixel and the third color pixel according to display image data and a first gamma curve.

The second controller is configured to determine display grayscales of the second sub-pixels of the first color pixel, the second color pixel and the third color pixel according to display image data and a second gamma curve.

The third controller is configured to determine display grayscales of the third sub-pixels of the first color pixel, the second color pixel and the third color pixel according to display image data and a third gamma curve; and the display grayscales of the first sub-pixel, the second sub-pixel and the third sub-pixel are different.

By means of the above-provided display panel, through the combination of three kinds of gamma curves i.e., the first gamma curve, the second gamma curve and the third gamma curve, the gamma curve in side view of the display panel approximates to the gamma curve in normal view, the color shift problem of the display panel can be improved in a certain extent.

In the following, the display panel provided above in the exemplary embodiment will be described in more detail with reference to FIG. 2 through FIG. 6.

In an illustrated embodiment, as shown in FIG. 3 and FIG. 4, each the pixel unit includes the first color pixel, the second color pixel and the third color pixel. Each of the first color pixel, the second color pixel and the third color pixel includes the first sub-pixel, the second sub-pixel and the third sub-pixel.

Exemplarily, on pixel unit in the illustrated embodiment is a pixel unit having nine sub-pixels as shown in FIG. 3, and the first color pixel of one pixel unit includes the first sub-pixel, the second sub-pixel and the third sub-pixel, such as three red sub-pixels. Similarly, the second color pixel includes three green sub-pixels, and the third color pixel includes three blue sub-pixels.

Specifically, display grayscales of the first sub-pixel, the second sub-pixel and the third sub-pixel respectively are different from one another. For example, the display grayscales of the three red sub-pixels are different from one another, the display grayscales of the three green sub-pixels are different from one another, and the display grayscales of the three blue sub-pixels are different from one another. As illustrated in FIG. 3, each of the first color pixel, the second color pixel and the third color pixel includes a H sub-pixel, a M sub-pixel and a L sub-pixel having different display grayscales. An arrangement of the H sub-pixel, the M sub-pixel and the L sub-pixel is irregular, and there is no restriction herein, but it is necessary to ensure that sub-pixels in any one square grid have the H sub-pixel, the M sub-pixel and the L sub-pixel.

In an embodiment, the display control unit includes the first controller, the second controller and the third controller. The first controller is configured to determine display grayscales of the first sub-pixels of the first color pixel, the second color pixel and the third color pixels according to display image data and the first gamma curve. The second controller is configured to determine display grayscales of the second sub-pixels of the first color pixel, the second color pixel and the third color pixels according to display image data and the second gamma curve. The third controller is configured to determine display grayscales of the third sub-pixels of the first color pixel, the second color pixel and the third color pixels according to display image data and the second gamma curve. As shown in FIG. 4, the first gamma curve is configured to control and regulate display grayscales of all the L sub-pixels, the second gamma curve is configured to control and regulate display grayscales of all the M sub-pixels, and the third gamma curve is configured to control and regulate display grayscales of all the H sub-pixels.

Exemplarily, the display panel is prestored with the first gamma curve, the second gamma curve and the third gamma curve. Iii an embodiment, the first gamma curve, the second gamma curve and the third gamma curve are different. The display control unit, after the display panel is turned on, adjusts actual display grayscales of sub-pixels in real time according to display image data such as grayscales and/or display brightnesses and the gamma curves corresponding to the sub-pixels.

Specifically, the first controller is configured to drive all the L sub-pixels and make the grayscales of the L sub-pixels reach preset grayscales by loading corresponding grayscale voltages onto data lines connected with the L sub-pixels. Likewise, the second controller is configured to drive all the M sub-pixels and make the grayscales of the M sub-pixels reach preset grayscales by loading corresponding grayscale voltages onto data lines connected with the NI sub-pixels. The third controller is configured to drive all the H sub-pixels and make the grayscales of the H sub-pixels reach preset grayscales by loading corresponding grayscale voltages onto data lines connected with the H sub-pixels.

Figure 5:
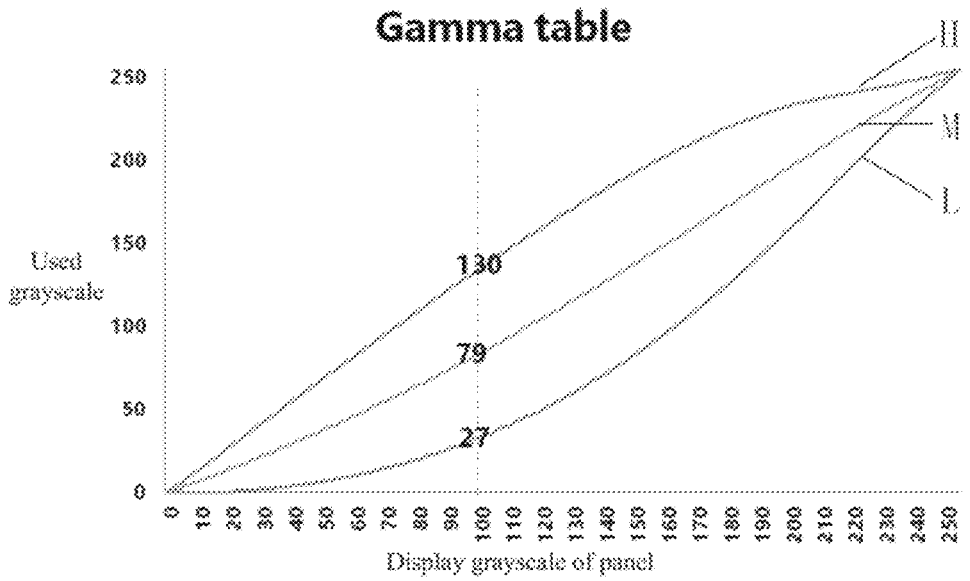
FIG. 5 is a schematic diagram of a gamma table obtained by regulating/debugging according to a first gamma curve, a second gamma curve and a third gamma curve in an exemplary embodiment of the invention.

When a display image is specifically presented, as illustrated in FIG. 5, the grayscale of the H sub-pixel is higher than the grayscale of the M sub-pixel, and the grayscale of the M sub-pixel is higher than the grayscale of the L sub-pixel. By mixing the grayscale of the L sub-pixel, the grayscale of the NI sub-pixel and the grayscale of the H sub-pixel, the gamma curve in side view of the display panel approaches the gamma curve in normal view of the display panel. For example, when an image of 100 grayscale is required to be displayed, a search can be done through a gamma table as shown in FIG. 5, so that the II sub-pixel is displayed as 130 grayscale, the M sub-pixel is displayed as 79 grayscale, and the L sub-pixel is displayed as 27 grayscale. The above gamma table can be obtained by regulating/debugging according to the first gamma curve, the second gamma curve and the third gamma curve.

Exemplarily, the first gamma curve, the second gamma curve and the third gamma curve are corresponding to the L gamma curve, the M gamma curve and the H gamma curve respectively; and a (L+M+H) gamma curve mixed by the L gamma curve, the NI gamma curve and the H gamma curve approximates the gamma curve in normal view of the display panel, so that the color shift problem in side view of the display panel can be improved in a certain extent.

In an embodiment, the number of the first sub-pixel, the number of the second sub-pixel and the number of the third sub-pixel are the same. Exemplarily, all the first sub-pixels, the second sub-pixels and the third sub-pixels arranged on the display panel, i.e., all the L sub-pixels, all the M sub-pixels and all the H sub-pixels shown in FIG. 4 are 1:1:1 in number, which can improve the color shift problem in side view of the display panel in a certain extent.

In an embodiment, each of the first through third sub-pixels in the display panel has a 4-domain pixel structure, i.e., multiple regions are formed in one sub-pixel and the multiple regions have different alignment directions, so as to obtain a large viewing angle, that is relieve the color shift in side view of the display panel. In the illustrated embodiment, because each sub-pixel is a 4-domain pixel structure, i.e., the L sub-pixel, the M sub-pixel and the H sub-pixel each are equipped with four domains, and moreover the display grayscales of the L sub-pixel, the M sub-pixel and the H sub-pixel are different from one another, i.e., deflection angles of liquid crystal molecules are different, so that the L sub-pixel, the M sub-pixel and the H sub-pixel form 12 photo-alignment directions to a certain extent, and a display manner of the display panel adopts a 12-domain pixel structure for image display, which further improves the color shift problem in side view of the display panel.

In an embodiment, the display panel is a 4K display panel or a 8K display panel, Because the illustrated embodiment combines three sub-pixels of different grayscales into one 12-domain pixel structure, the color shift problem in side view of the display panel would be improved by resolution reduction. Therefore, the graininess of the display image may be relatively serious, but if it is applied to a display panel with a resolution of 4K or above, the graininess of the display image would be significantly reduced, ensuring the display effect of image.

Figure 6:
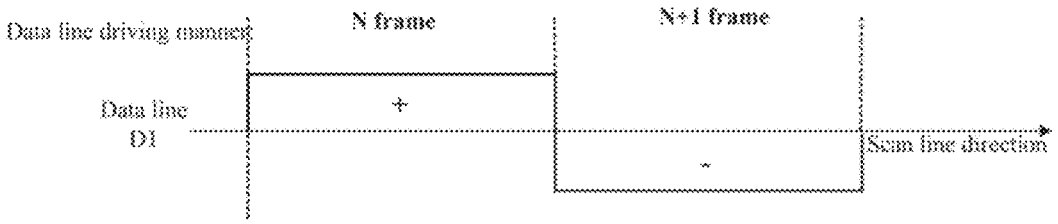
FIG. 6 is a schematic diagram of a column inversion driving manner in an exemplary embodiment of the invention.

In the illustrated embodiment, a driving manner of the pixel unit is a column inversion, but it is not limited to this. As illustrated in FIG. 6, the data line D1 in the drawing is given a positive polarity in an Nth frame period, and is given a negative polarity in an (N+1)th frame period. A detailed driving manner can refer to that in the prior art and thus will be not repeated herein.

Figure 7:
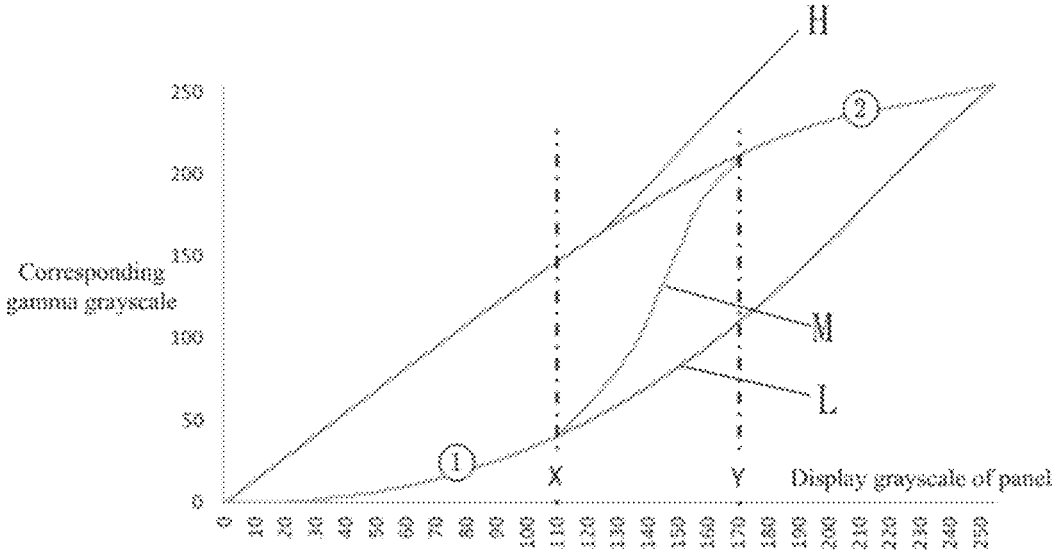
FIG. 7 is a schematic diagram of a gamma table obtained by regulating according to a first gamma curve, a second gamma curve and a third gamma curve in another exemplary embodiment of the invention.

Moreover, a display panel is provided in another exemplary embodiment, and the display panel may be applied to a terminal equipment, such as a mobile phone, a personal digital assistant, a notebook computer, a tablet computer, a smart watch or other mobile terminal. Referring to FIG. 2 and FIG. 7, the display panel includes:

multiple pixel units, each of the pixel units including a first color pixel, a second color pixel and a third color pixel, each of the first color pixel, the second color pixel and the third color pixel including a first sub-pixel, a second sub-pixel and a third sub-pixel; and a display control unit, including a first controller, a second controller and a third controller.

The first controller is configured to determine display grayscales of the first sub-pixels of the first color pixel, the second color pixel and the third color pixel according to display image data and a first gamma curve.

The second controller is configured to determine display grayscales of the second sub-pixels of the first color pixel, the second color pixel and the third color pixel according to display image data and a second gamma curve.

The third controller is configured to determine display grayscales of the third sub-pixels of the first color pixel, the second color pixel and the third color pixel according to display image data and a third gamma curve.

The second gamma curve includes a first curve segment, a second curve segment and a third curve segment. The first curve segment is overlapped with the first gamma curve, and the third curve segment is overlapped with the third gamma curve.

By means of the above described display panel, through adopting three kinds of gamma curves i.e., the first gamma curve, the second gamma curve and the third gamma curve, a gamma curve in side view of the display panel approximates a gamma curve in normal view of the display panel, which can improve the color shift problem in side view of the display panel in a certain extent.

In the following, the above described display panel in this exemplary embodiment will be described in more detail with reference to FIG. 2 through FIG. 10.

In another embodiment, each the pixel unit includes the first color pixel, the second color pixel and the third color pixel; and each of the first color pixel, the second color pixel and the third color pixel includes the first sub-pixel, the second sub-pixel and the third sub-pixel. Exemplarily, one pixel unit is a pixel unit having nine sub-pixels as shown in FIG. 3, and the first color pixel in one pixel unit includes the first sub-pixel, the second sub-pixel and the third sub-pixel, for example three red sub-pixels. Similarly, the second color pixel includes three green sub-pixels, and the third color pixel includes three blue sub-pixels.

In particular, as shown in FIG. 7, the first sub-pixel is denoted as L sub-pixel, the second sub-pixel is denoted as M sub-pixel, and the third sub-pixel is denoted as II sub-pixel.

When a display grayscale of the display panel is lower than an X grayscale, the grayscale of the L sub-pixel is the same as the grayscale of the M sub-pixel, but different from the display grayscale of the H sub-pixel; for example, two sub-pixels in three red sub-pixels display a same grayscale and the other one red sub-pixel displays a grayscale higher than the same grayscale of the two sub-pixels. Likewise, two sub-pixels in three green sub-pixels display a same grayscale and the other one green sub-pixel displays a grayscale higher than the same grayscale of the two sub-pixels. Two sub-pixels in three blue sub-pixels display a same grayscale and the other one blue sub-pixel displays a grayscale higher than the same grayscale of the two sub-pixels.

When the display grayscale of the display panel is higher than a Y grayscale, the display grayscale of the M sub-pixel is the same as the display grayscale of the H sub-pixel, but different from the display grayscale of the L sub-pixel; for example, two sub-pixels in three red sub-pixels display a same grayscale and the other one red sub-pixel displays a grayscale lower than the same grayscale of the two sub-pixels. Likewise, two sub-pixels in three green sub-pixels display a same grayscale and the other one green sub-pixel displays a grayscale lower than the same grayscale of the two sub-pixels. Two sub-pixels in three blue sub-pixels display a same grayscale and the other one blue sub-pixel displays a grayscale lower than the same grayscale of the two sub-pixels.

When the display grayscale of the display panel is between the X grayscale and the Y grayscale, the display grayscales of the L sub-pixel, the M sub-pixel and the H sub-pixel are different from one another; for example, three red sub-pixels have different display grayscales, three green sub-pixels have different display grayscales, and three blue sub-pixels have different display grayscales.

In an embodiment, the first gamma curve corresponding to the L sub-pixel is denoted as L gamma curve, the second gamma curve corresponding to the NI sub-pixel is denoted as M gamma curve, and the third gamma curve corresponding to the H sub-pixel is denoted as H gamma curve. The second gamma curve includes a first curve segment, a second curve segment and a third curve segment. The first curve segment is overlapped with the first gamma curve, and the third curve segment is overlapped with the third gamma curve.

Specifically, as illustrated in FIG. 7, when the display grayscale of the display panel is lower than the X grayscale, the L gamma curve coincides with the first curve segment of the M gamma curve, i.e., the segment ① shown in FIG. 7; at this situation, the M sub-pixel is adjusted to regulate the grayscale as per the L gamma curve, and with respect to the M sub-pixels shown in FIG. 4, all the M sub-pixels are replaced as corresponding L sub-pixels in FIG. 8, so that the L sub-pixels, the M sub-pixels and the H sub-pixels in the display panel are 2:0:1 in number, that is to say, it can be considered as there are only L sub-pixels and H sub-pixels in the display panel.

Similarly, when the display grayscale of the display panel is greater than the Y grayscale, the H gamma curve coincides with the third curve segment of the M gamma curve, i.e., the segment ② shown in FIG. 7; at this situation, the M sub-pixel is adjusted to regulate the grayscale as per the H gamma curve, and with respect to the M sub-pixels shown in FIG. 4, all the M sub-pixels are replaced as corresponding H sub-pixels in FIG. 9, so that the L sub-pixels, the M sub-pixels and the H sub-pixels in the display panel are 1:0:2 in number, that is to say, it can be considered as there are only L sub-pixels and H sub-pixels in the display panel.

When the display grayscale of the display panel is between the X grayscale and the Y grayscale, the L sub-pixel, the M sub-pixel and the H sub-pixel are respectively corresponding to the L gamma curve, the second curve segment of the M gamma curve, and the H gamma curve. At this situation, the L sub-pixels, the M sub-pixels and the H sub-pixels in the display panel are 1:1:1 in number.

In an embodiment, grayscales respectively corresponding to the first curve segment, the second curve segment and the third curve segment are progressively increased.

Exemplarily, the first curve segment is the segment ① coincided with the L gamma curve when the display image grayscale is lower than the X grayscale, the third curve segment is the segment ② coincided with the H gamma curve when the display image grayscale is higher than the Y grayscale, and the second curve segment is corresponding to the M gamma curve between the L gamma curve and the H gamma curve, and thus the grayscales respectively corresponding to the first curve segment, the second curve segment and the third curve segment are progressively increased.

In an embodiment, the first controller is configured to determine display grayscales of the first sub-pixels of the first color pixel, the second color pixel and the third color pixel according to display image data and the first gamma curve; the second controller is configured to determine display grayscales of the second sub-pixels of the first color pixel, the second color pixel and the third color pixel according to display image data and the second gamma curve; and the third controller is configured to determine display grayscales of the third sub-pixels of the first color pixel, the second color pixel and the third color pixel according to display image data and the third gamma curve.

Specifically, the display panel is prestored with the first gamma curve, the second gamma curve and the third gamma curve. The first controller is configured to drive all L sub-pixels and make grayscales of the L sub-pixels reach preset grayscales by loading corresponding grayscale voltages onto data lines connected with the L sub-pixels. Likewise, the second controller is configured to drive all NI sub-pixels and make grayscales of the M sub-pixels reach preset grayscales by loading corresponding grayscale voltages onto data lines connected with the NI sub-pixels; and the third controller is configured to drive all H sub-pixels and make grayscales of the NI sub-pixels reach preset grayscales by loading corresponding grayscale voltages onto data lines connected with the H sub-pixels.

Exemplarily, in order to achieve the effect of combining/mixing the L gamma curve, the NI gamma curve and the H gamma curve to approach the gamma curve in normal view of the display panel, referring to the gamma table obtained from the debugging of L gamma curve, M gamma curve and H gamma curve for understanding, as illustrated in FIG. 7, when the display grayscale of the panel is lower than 110 grayscale, the NI gamma curve corresponding to the M sub-pixels is the same as the L gamma curve; when the display grayscale of the panel s higher than 170 grayscale, the M gamma curve corresponding to the M sub-pixels is the same as the H gamma curve; and when the display grayscale of the panel is higher than 110 grayscale and lower than 170 grayscale, the M gamma curve is different from the L gamma curve and the H gamma curve. By adopting the above matching method, it can solve the related technical problems to a certain extent that: when the grayscale is lower than N, the gamma curve (H+L) in side view is relatively higher than the gamma curve in normal view; and when the grayscale is higher than N, the gamma curve (H+L) in side view is relatively lower than the gamma curve in normal view. As a result, the color shift problem in side view of the display panel is further improved.

In an embodiment, each of the first sub-pixel, the second sub-pixel and the third sub-pixel is a 4-domain pixel structure; and the display panel is a 4K display panel or a 8K display panel. For details, please refer to the foregoing embodiments, and thus will not be repeated herein.

In addition, a display device is provided in an exemplary embodiment, and the display device includes the display panel of any one of above embodiments. For details, please refer to the detailed description associated with the above display panel.

According to the above provided display device; a display technology based on a 12-domain pixel structure can be realized, which can significantly improve the color shift problem in side view of the display panel.

Furthermore, an exemplary embodiment provides a driving method for a display panel. The display panel includes multiple pixel units. Each of the pixel units includes a first color pixel, a second color pixel and a third color pixel. Each of the first color pixel, the second color pixel and the third color pixel includes a first sub-pixel, a second sub-pixel and a third sub-pixel. The driving method includes:

determining a display grayscale of the first sub-pixel of the first color pixel, a display grayscale of the first sub-pixel of the second color pixel, and a display grayscale of the first sub-pixel of the third color pixel according to display image data and a first gamma curve;

determining a display grayscale of the second sub-pixel of the first color pixel, a display grayscale of the second sub-pixel of the second color pixel, and a display grayscale of the second sub-pixel of the third color pixel according to display image data and a second gamma curve;

determining a display grayscale of the third sub-pixel of the first color pixel, a display grayscale of the third sub-pixel of the second color pixel, and a display grayscale of the third sub-pixel of the third color pixel according to display image data and a third gamma curve; and driving the first sub-pixels, the second sub-pixels and the third sub-pixels to present a display image according to the determined display grayscales of the first sub-pixels, the second sub-pixels and the third sub-pixels.

Specifically, a first controller is configured to drive all first sub-pixels and make grayscales of the first sub-pixels reach preset grayscales by loading/applying corresponding grayscale voltages onto data lines connected with the first sub-pixels. Likewise, a second controller is configured to drive all second sub-pixels and make grayscales of the second sub-pixels reach preset grayscales by loading corresponding grayscale voltages onto data lines connected with the second sub-pixels; and a third controller is configured to drive all third sub-pixels and make grayscales of the third sub-pixels reach preset grayscales by loading corresponding grayscale voltages onto data lines connected with the third sub-pixels.

By means of the display panel, the display panel and the driving method for a display panel provided by the above exemplary embodiments, through combining three kinds of gamma curves, i.e., the first gamma curve, the second gamma curve and the third gamma curve, and taking a 4-domain pixel structure as a basis, a display effect based on a 12-domain pixel structure can be realized, which can significantly improve the color shift problem in side view of the display panel.

It should be noted that although the steps of the method as disclosed in the invention are described in a specific order in the drawings, it does not require or implies that these steps must be performed in the specific order, or that all the steps shown must be performed to achieve the desired result. Additionally or alternatively, some of the steps may be omitted, multiple of the steps may be combined into one step for execution, and/or one step may be decomposed into multiple steps for execution, etc. In addition, it is also easy to understand that these steps can be performed synchronously or asynchronously, for example, in multiple modules/processes/threads.

It should be noted that although several modules or units of equipment for action execution are mentioned in the above detailed description, this division is not mandatory. In fact, according to embodiments of the invention, the features and functions of two or more modules or units described above may be embodied in one module or unit. Conversely, the features and functions of one module or unit described above can be further divided into multiple modules or units. The components displayed as modules or units may or may not be physical units, that is, they may be located in one place, or they may be distributed over multiple network units. Some or all of the modules can be selected according to the actual needs to achieve the purpose of the invention. Those skilled in the art can understand and implement without creative effort.

Those skilled in the art would easily think of other embodiments of the invention after considering the specification and practicing the invention disclosed herein The invention aims to cover any modifications, uses or adaptive changes of the exemplary embodiments. These variations, uses, or adaptive changes follow the general principle of the invention and include common knowledge or conventional technical means in the technical field that are not disclosed in the embodiments of the invention. The description and the embodiments are only regarded as exemplary, and the true scope and spirit of the invention are pointed out by the appended claims.

What is claimed is:

1. A display panel comprising:

a plurality of pixel units, wherein each of the plurality of pixel units comprises a first color pixel, a second color pixel and a third color pixel, and each of the first color pixel, the second color pixel and the third color pixel comprises a first sub-pixel, a second sub-pixel and a third sub-pixel; and a display control unit, comprising a first controller, a second controller and a third controller;

wherein the first controller is configured to determine a display grayscale of the first sub-pixel of the first color pixel, a display grayscale of the first sub-pixel of the second color pixel and a display grayscale of the first sub-pixel of the third color pixel according to display image data and a first gamma curve;

wherein the second controller is configured to determine a display grayscale of the second sub-pixel of the first color pixel, a display grayscale of the second sub-pixel of the second color pixel and a display grayscale of the second sub-pixel of the third color pixel according to display image data and a second gamma curve;

wherein the third controller is configured to determine a display grayscale of the third sub-pixel of the first color pixel, a display grayscale of the third sub-pixel of the second color pixel and a display grayscale of the third sub-pixel of the third color pixel according to display image data and a third gamma curve;

wherein the display grayscales of the first sub-pixel, the second sub-pixel and the third sub-pixel of each of the first through third color pixels are different; the first sub-pixel, the second sub-pixel and the third sub-pixel of each of the first through third color pixels are different ones of a H sub-pixel, a M sub-pixel and a L sub-pixel having different display grayscales; the display grayscale of the H sub-pixel is higher than the display grayscale of the M sub-pixel, and the display grayscale of the M sub-pixel is higher than the display grayscale of the L sub-pixel; and all sub-pixels in every square grid contain the H sub-pixel, the M sub-pixel and the L sub-pixel;

wherein the first gamma curve, the second gamma curve and the third gamma curve are different; and the second gamma curve is located between the first gamma curve and the third gamma curve.

2. The display panel according to claim 1, wherein the first sub-pixel, the second sub-pixel and the third sub-pixel of each of the first through third color pixels are same in number.

3. The display panel according to claim 1, wherein each of the first sub-pixel, the second sub-pixel and the third sub-pixel of each of the first through third color pixels is a 4-domain pixel structure.

4. The display panel according to claim 1, wherein the display panel is a 4K display panel or a 8K display panel.

5. The display panel according to claim 1, wherein the first gamma curve, the second gamma curve and the third gamma curve are prestored in the display panel.

6. The display panel according to claim 1, wherein the first controller is configured to drive all the first sub-pixels of the plurality of pixel units and make the first sub-pixels reach preset grayscales by loading corresponding grayscale voltages onto data lines connected with the first sub-pixels; the second controller is configured to drive all the second sub-pixels of the plurality of pixel units and make the second sub-pixels reach preset grayscales by loading corresponding grayscale voltages onto data lines connected with the second sub-pixels; and the third controller is configured to drive all the third sub-pixels of the plurality of pixel units and make the third sub-pixels reach preset grayscales by loading corresponding grayscale voltages onto data lines connected with the third sub-pixels.

7. A display panel comprising:

a plurality of pixel units, wherein each of the plurality of pixel units comprises a first color pixel, a second color pixel and a third color pixel, and each of the first color pixel, the second color pixel and the third color pixel comprises a first sub-pixel, a second sub-pixel and a third sub-pixel; and a display control unit, comprising a first controller, a second controller and a third controller;

wherein the first controller is configured to determine a display grayscale of the first sub-pixel of the first color pixel, a display grayscale of the first sub-pixel of the second color pixel and a display grayscale of the first sub-pixel of the third color pixel according to display image data and a first gamma curve;

wherein the second controller is configured to determine a display grayscale of the second sub-pixel of the first color pixel, a display grayscale of the second sub-pixel of the second color pixel and a display grayscale of the second sub-pixel of the third color pixel according to display image data and a second gamma curve;

wherein the third controller is configured to determine a display grayscale of the third sub-pixel of the first color pixel, a display grayscale of the third sub-pixel of the second color pixel and a display grayscale of the third sub-pixel of the third color pixel according to display image data and a third gamma curve;

wherein the first sub-pixel, the second sub-pixel and the third sub-pixel of each of the first through third color pixels are a L sub-pixel, a M sub-pixel and a H sub-pixel respectively;

wherein the second gamma curve consists of a first curve segment, a second curve segment and a third curve segment; the first curve segment is overlapped with the first gamma curve and thereby a display grayscale of the L sub-pixel is the same as a display grayscale of the M sub-pixel but lower than a display grayscale of the H sub-pixel when a display grayscale of the display panel is lower than a first grayscale; the third curve segment is overlapped with the third gamma curve and thereby the display grayscale of the M sub-pixel is the same as the display grayscale of the H sub-pixel but higher than the display grayscale of the L sub-pixel when the display grayscale of the display panel is higher than a second grayscale; the display grayscale of the H sub-pixel is higher than the display grayscale of the M sub-pixel and the display grayscale of the M sub-pixel is higher than the display grayscale of L sub-pixel when the display grayscale of the display panel is between the first grayscale and the second grayscale; and the second grayscale is higher than the first grayscale.

8. The display panel according to claim 7, wherein each of the first sub-pixel, the second sub-pixel and the third sub-pixel of each of the first through third color pixels is a 4-domain pixel structure.

9. The display panel according to claim 7, wherein the display panel is a 4K display panel or a 8K display panel.

10. The display panel according to claim 7, wherein the first gamma curve, the second gamma curve and the third gamma curve are different.

11. The display panel according to claim 10, wherein grayscales respectively corresponding to the first curve segment, the second curve segment and the third curve segment are progressively increased.

12. The display panel according to claim 7, wherein the first controller is configured to drive all the first sub-pixels of the plurality of pixel units and make the first sub-pixels reach preset grayscales by loading corresponding grayscale voltages onto data lines connected with the first sub-pixels; the second controller is configured to drive all the second sub-pixels of the plurality of pixel units and make the second sub-pixels reach preset grayscales by loading corresponding grayscale voltages onto data lines connected with the second sub-pixels; and the third controller is configured to drive all the third sub-pixels of the plurality of pixel units and make the third sub-pixels reach preset grayscales by loading corresponding grayscale voltages onto data lines connected with the third sub-pixels.

13. A driving method for a display panel, wherein the display panel comprises a plurality of pixel units, each of the plurality of pixel units comprises a first color pixel, a second color pixel and a third color pixel; and each of the first color pixel, the second color pixel and the third color pixel comprises a first sub-pixel, a second sub-pixel and a third sub-pixel;

wherein the driving method comprises:

determining a display grayscale of the first sub-pixel of the first color pixel, a display grayscale of the first sub-pixel of the second color pixel and a display grayscale of the first sub-pixel of the third color pixel according to display image data and a first gamma curve;

determining a display grayscale of the second sub-pixel of the first color pixel, a display grayscale of the second sub-pixel of the second color pixel and a display grayscale of the second sub-pixel of the third color pixel according to display image data and a second gamma curve;

determining a display grayscale of the third sub-pixel of the first color pixel, a display grayscale of the third sub-pixel of the second color pixel and a display grayscale of the third sub-pixel of the third color pixel according to display image data and a third gamma curve; and driving the first sub-pixels, the second sub-pixels and the third sub-pixels to present a display image according to the display grayscales of the first sub-pixels, the second sub-pixels and the third sub-pixels as determined;

wherein the first sub-pixel, the second sub-pixel and the third sub-pixel of each of the first through third color pixels are different ones of a H sub-pixel, a M sub-pixel and a L sub-pixel having different display grayscales; the display grayscale of the H sub-pixel is higher than the display grayscale of the M sub-pixel, and the display grayscale of the M sub-pixel is higher than the display grayscale of the L sub-pixel; and all sub-pixels in every square grid have the H sub-pixel, the M sub-pixel and the L sub-pixel;

wherein the first gamma curve, the second gamma curve and the third gamma curve are different from one another; and the second curve is located between the first gamma curve and the third gamma curve.

* * * * *